US010984943B2

(12) United States Patent
Kudo

(10) Patent No.: US 10,984,943 B2
(45) Date of Patent: Apr. 20, 2021

(54) ELECTRONIC DEVICE

(71) Applicant: TDK CORPORATION, Tokyo (JP)

(72) Inventor: Takashi Kudo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 140 days.

(21) Appl. No.: 16/014,101

(22) Filed: Jun. 21, 2018

(65) Prior Publication Data

US 2019/0006089 A1 Jan. 3, 2019

(30) Foreign Application Priority Data

Jun. 30, 2017 (JP) ..... JP2017-129424

(51) Int. Cl.

| | |
|---|---|
| ***H01F 27/29*** | (2006.01) |
| ***H01F 5/00*** | (2006.01) |
| ***H01F 27/28*** | (2006.01) |
| ***H01F 17/00*** | (2006.01) |
| ***H01F 17/04*** | (2006.01) |

(52) U.S. Cl.

CPC ..... *H01F 27/292* (2013.01); *H01F 5/003* (2013.01); *H01F 17/0013* (2013.01); *H01F 17/04* (2013.01); *H01F 27/2804* (2013.01); *H01F 2017/048* (2013.01)

(58) Field of Classification Search

CPC ..... H01F 27/292

See application file for complete search history.

(56) References Cited

U.S. PATENT DOCUMENTS

| | | | | |
|---|---|---|---|---|
| 3,612,963 | A * | 10/1971 | Piper | H01G 4/2325 361/321.3 |
| 5,572,779 | A * | 11/1996 | Adelman | H01F 41/046 257/E23.061 |
| 2002/0070442 | A1* | 6/2002 | Ahiko | H05K 3/3442 257/703 |
| 2006/0006972 | A1* | 1/2006 | Tozawa | H01F 17/0013 336/200 |
| 2007/0014075 | A1* | 1/2007 | Ritter | H01G 4/30 361/306.3 |
| 2007/0040163 | A1* | 2/2007 | Okuzawa | H01F 27/292 257/31 |
| 2011/0235232 | A1* | 9/2011 | Takeuchi | H01G 4/30 361/301.1 |
| 2013/0257576 | A1* | 10/2013 | Arata | H01F 27/2804 336/200 |
| 2017/0018351 | A1* | 1/2017 | Yatabe | H01F 27/2804 |
| 2018/0033556 | A1* | 2/2018 | Itamochi | H01C 7/008 |
| 2019/0228899 | A1* | 7/2019 | Maki | H01F 41/046 |

FOREIGN PATENT DOCUMENTS

| | | | |
|---|---|---|---|
| JP | 2002305111 | A * | 10/2002 |
| JP | 2012-104745 | A | 5/2012 |
| JP | 2012104745 | A * | 5/2012 |
| JP | 2013-211302 | A | 10/2013 |

* cited by examiner

*Primary Examiner* — Elvin G Enad
*Assistant Examiner* — Malcolm Barnes
(74) *Attorney, Agent, or Firm* — Oliff PLC

(57) ABSTRACT

An electronic device includes a component body and a terminal electrode formed on a mounting surface of the component body. The chamfered part is formed at an intersection between the mounting surface and a side surface of the component body. An edge of the terminal electrode becomes thinner toward the chamfered part.

10 Claims, 9 Drawing Sheets

ELECTRONIC DEVICE

BACKGROUND OF THE INVENTION

1. Field of the Invention

The present invention relates to an electronic device used as a chip component.

2. Description of the Related Art

In an electronic device such as a chip component, a terminal electrode is formed continuously even on a side surface together with a mounting surface, in order to form a solder filet on the side surface of the terminal electrode.

In this type of electronic devices, however, if the electronic devices adjacent to each other are arranged closely in high-density mounting or so, solder reaches between the electronic devices adjacent to each other, and solder bridge is thereby easy to occur. Thus, short circuit failure may occur between the electronic devices adjacent to each other.

On the other hand, Patent Document 1 discloses that a terminal electrode is formed only on a mounting surface in the multilayer coil device. Thus, short circuit failure can be prevented from occurring between the electronic devices adjacent to each other.

In the multilayer coil device of Patent Document 1, however, the terminal electrode is formed away from a side surface of an element body, a sufficient area of the terminal electrode cannot be secured, and mounting strength may decrease.

Patent Document 1: JP2013211302 (A)

SUMMARY OF THE INVENTION

The present invention has been achieved under such circumstances. It is an object of the invention to provide an electronic device excellent in high-density mounting while a sufficient area of a terminal electrode is secured.

To achieve the above object, an electronic device according to the present invention comprises:

a component body; and a terminal electrode formed on a mounting surface of the component body, wherein a chamfered part is formed at an intersection between the mounting surface and a side surface of the component body, and wherein an edge of the terminal electrode becomes thinner toward the chamfered part.

In the electronic device according to the present invention, the chamfered part is formed at the intersection between the mounting surface and the side surface of the component body, and the edge of the terminal electrode becomes thinner toward the chamfered part. That is, the edge of the terminal electrode is chamfered integrally with the intersection between the mounting surface and the side surface of the component body in forming the chamfered part in the present invention. Thus, the edge of the terminal electrode is arranged inside the side surface of the component body and is smoothly (continuously) connected with the chamfered surface of the chamfered part while being gently curved. During high-density mounting, it thereby becomes harder for solder to protrude outward from the component body and to reach between the electronic devices adjacent to each other, compared to prior arts. Thus, it is possible to effectively prevent generation of solder bridge between the terminal electrodes adjacent to each other and to effectively prevent generation of short circuit failure between the terminal electrodes adjacent to each other. Since the edge of the terminal electrode reaches near the chamfered part, it is possible to secure a sufficient area of the terminal electrode and to secure an excellent mounting strength even if a chip size is small.

The chamfered part may be an R-plane or a C-plane depending on required standard, usage, and the like.

To achieve the above object, a method of manufacturing the electronic device according to the present invention comprises the steps of:

obtaining a component body containing an element so that at least a part of a lead is exposed;

forming a terminal electrode even near a side surface of the component body on a mounting surface of the component body so that the terminal electrode is connected with at least a part of the lead exposed from the component body; and forming a chamfered part at an intersection between the mounting surface and the side surface of the component body.

In the method of manufacturing the electronic device (chip component), a step of forming the terminal electrode on the component body is normally carried out after a step of forming the chamfered part on the component body. In the present invention, however, a step of forming the chamfered part on the component body is carried out after a step of forming the terminal electrode on the component body. In the method according to the present invention, the edge of the terminal electrode is chamfered together with the intersection between the mounting surface and the side surface of the component body in forming the chamfered part. Thus, it is possible to easily manufacture pieces of the electronic device where the edge of the terminal electrode becomes gradually thinner toward the chamfered part.

To achieve the above object, a method of manufacturing the electronic device according to the present invention comprises the steps of:

obtaining a substrate containing a plurality of elements so that at least a part of a lead is exposed;

forming a terminal electrode in a predetermined pattern on one of surfaces of the substrate so that the terminal electrode is connected with at least a part of the lead exposed from the substrate;

cutting the substrate with the terminal electrode so that the predetermined pattern is cut; and forming a chamfered part at an intersection between a mounting surface and a side surface of the cut substrate.

In the method according to the present invention, the edge of the terminal electrode is chamfered together with the intersection between the mounting surface and the side surface of the cut substrate in forming the chamfered part. Thus, it is possible to easily manufacture an aggregation of the electronic device where the edge of the terminal electrode gradually becomes thinner toward the chamfered part. The terminal electrode pattern does not attach to each cut surface of the aggregation of the electronic device, and it is possible to manufacture the electronic device with the terminal electrode formed only on the mounting surface.

DETAILED DESCRIPTION OF THE PREFERRED EMBODIMENT

Hereinafter, the present invention is described based on an embodiment shown in the figures.

Figure 1A:
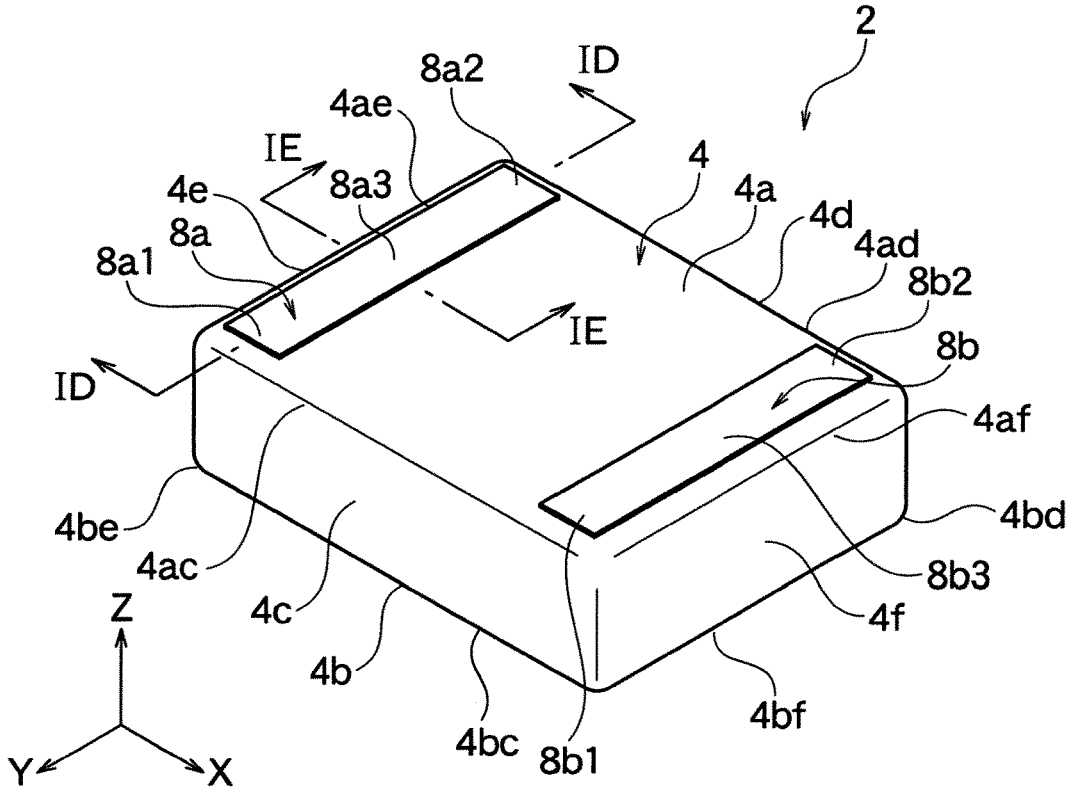
FIG. 1A is a perspective view of an electronic device according to an embodiment of the present invention.

As shown in FIG. 1A, an inductor 2 as an electronic device (chip component) according to an embodiment of the present invention has a component body (element body) 4 having an approximately rectangular-parallelopiped shape (approximately hexahedron shape). Incidentally, the electronic device of the present invention is not limited to the inductor 2, but may be another coil device, a capacitor, a resistor, a noise filter, a transformer, a chip component, or the like.

The component body 4 has a mounting surface 4*a*, a rear surface 4*b* opposite to the mounting surface 4*a* in the Z-axis direction, and four side surfaces 4*c* to 4*f*. The component body 4 has any size. For example, the component body 4 preferably has a length (X-axis) of 1.4 to 6.5 mm, preferably has a width (Y-axis) of 0.6 to 6.5 mm, and a height (Z-axis) of 0.5 to 5.0 mm.

Figure 1B:
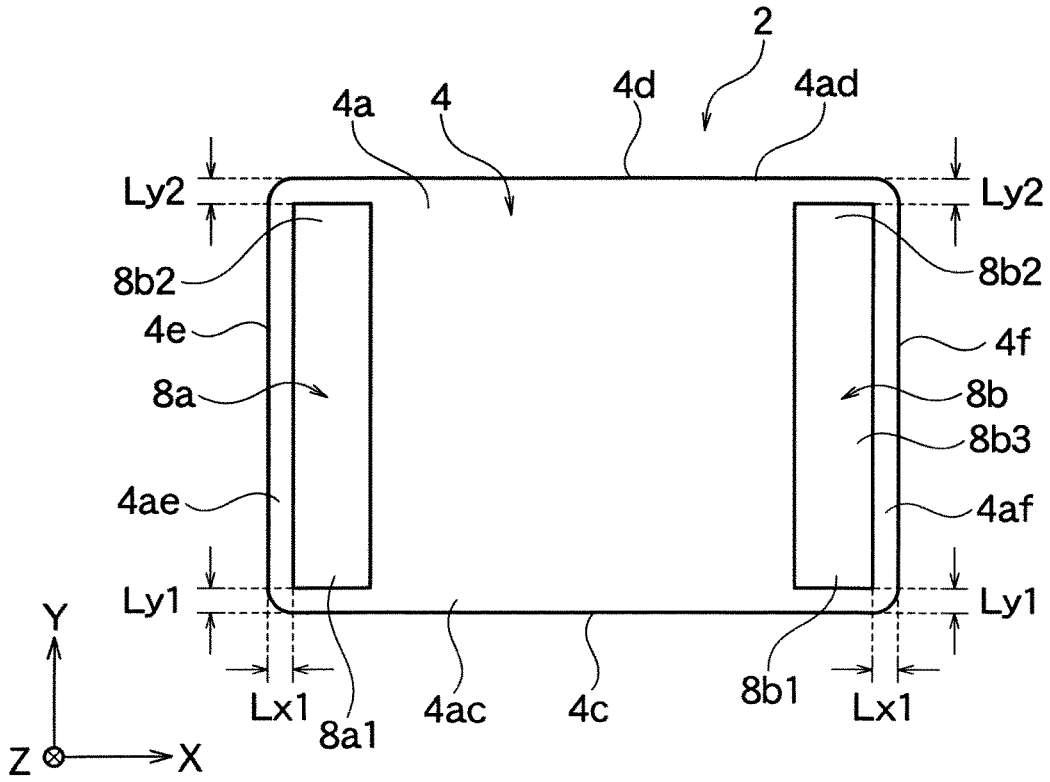
FIG. 1B is a plane view of the electronic device.
Figure 1C:
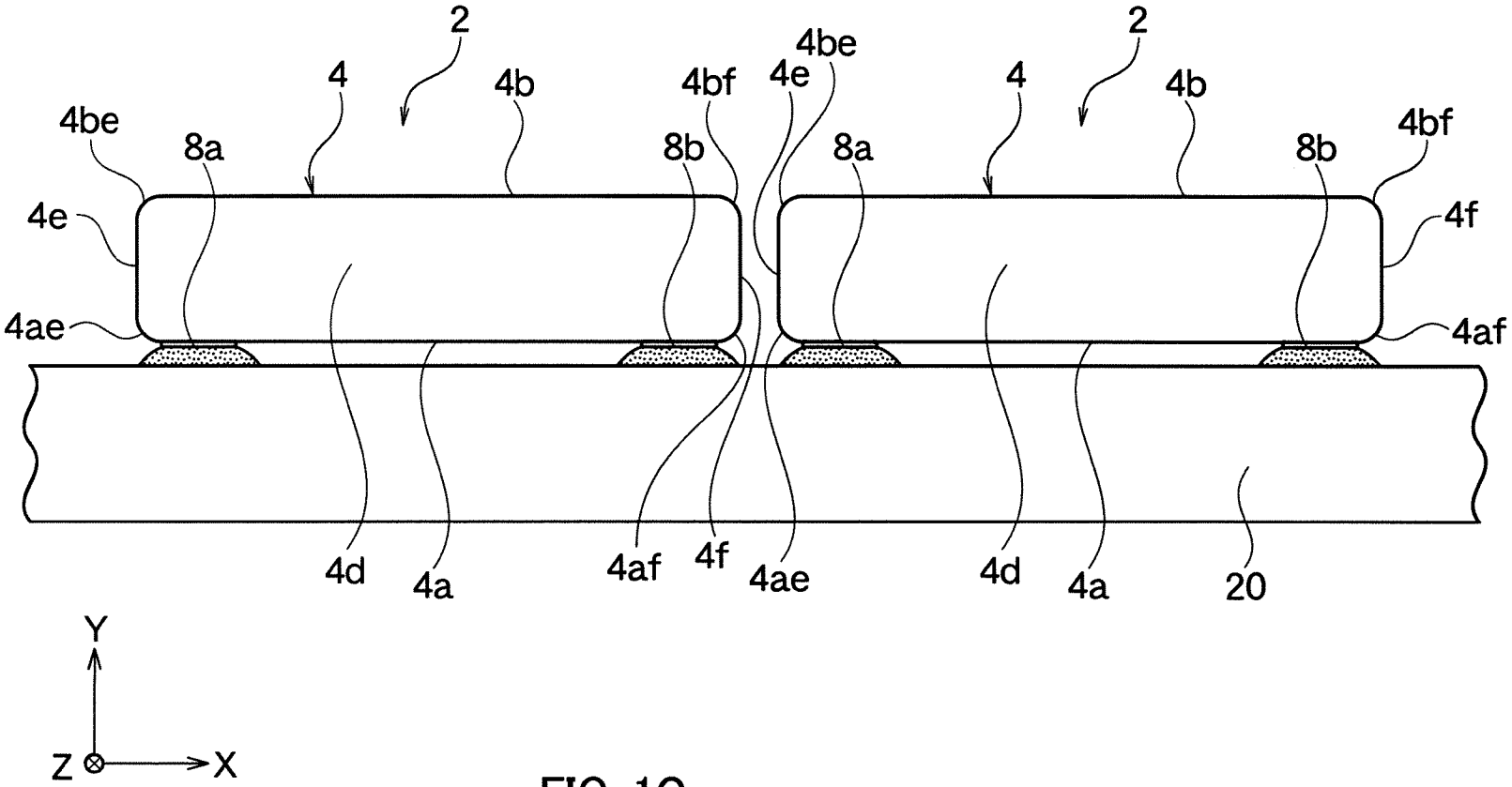
FIG. 1C is a cross-sectional view of the electronic device mounted on a circuit board.

In the present embodiment, as shown in FIG. 1A and FIG. 1C, chamfered parts 4*ac*, 4*ad*, 4*ae*, and 4*af* are formed respectively at intersections (corners) between the mounting surface 4*a* and the side surfaces 4*c*, 4*d*, 4*e*, and 4*f* of the component body 4. The chamfered parts 4*ac* to 4*af* are formed by R-planes (rounded), but may be formed by C-planes depending on required standard, usage, and the like. Preferably, chamfered surfaces of the chamfered parts 4*ac* to 4*af* have a curvature radius of 0.03 to 0.20 mm. Incidentally, the chamfered parts 4*ac* to 4*af* formed by C-planes have a chamfer width appropriately determined so that an outer shape similar to that of the chamfered parts 4*ac* to 4*af* formed by R-planes is obtained.

Likewise, chamfered parts 4*bc*, 4*bd*, 4*be*, and 4*bf* are formed respectively at intersections (corners) between the rear surface 4*b* and the side surfaces 4*c*, 4*d*, 4*e*, and 4*f* of the component body 4. The chamfered parts 4*bc* to 4*bf* are formed by R-planes (rounded), but may be formed by C-planes depending on required standard, usage, and the like.

In the present embodiment, the component body 4 is composed of a synthetic resin where ferrite particles or metal magnetic particles are dispersed, but may be composed of a synthetic resin that does not contain ferrite particles or metal magnetic particles. The ferrite particles are Ni—Zn based ferrite, Mn—Zn based ferrite, or the like. The metal magnetic particles are not limited, and are Fe—Ni alloy powder, Fe—Si alloy powder, Fe—Si—Cr alloy powder, Fe—Co alloy powder, Fe—Si—Al alloy powder, or the like.

The synthetic resin contained in the component body 4 is not limited, but is preferably an epoxy resin, a phenol resin, a polyester resin, a polyurethane resin, a polyimide resin, or the like.

Figure 2A:
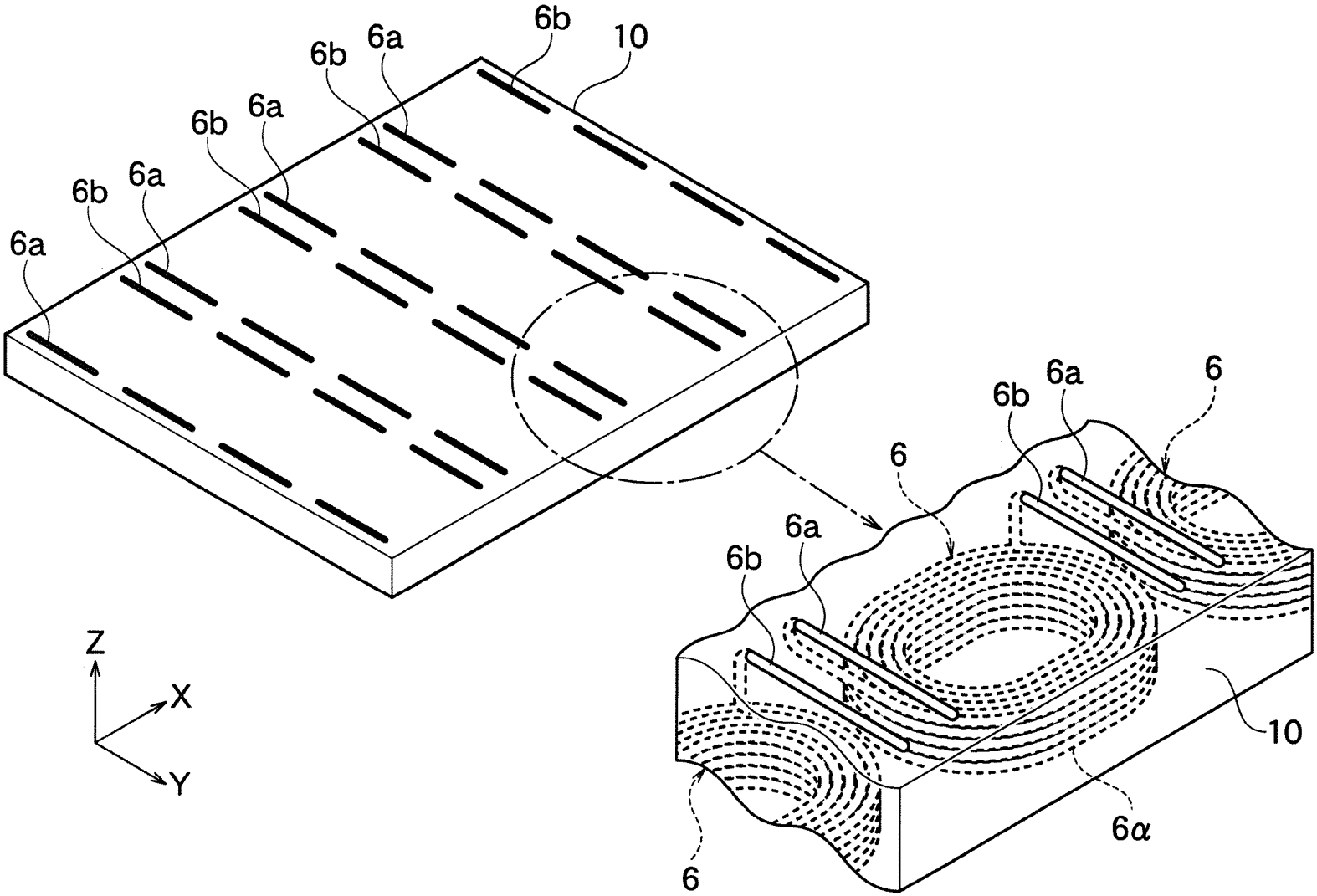
FIG. 2A is a perspective view showing a process of manufacturing the electronic device.
Figure 2B:
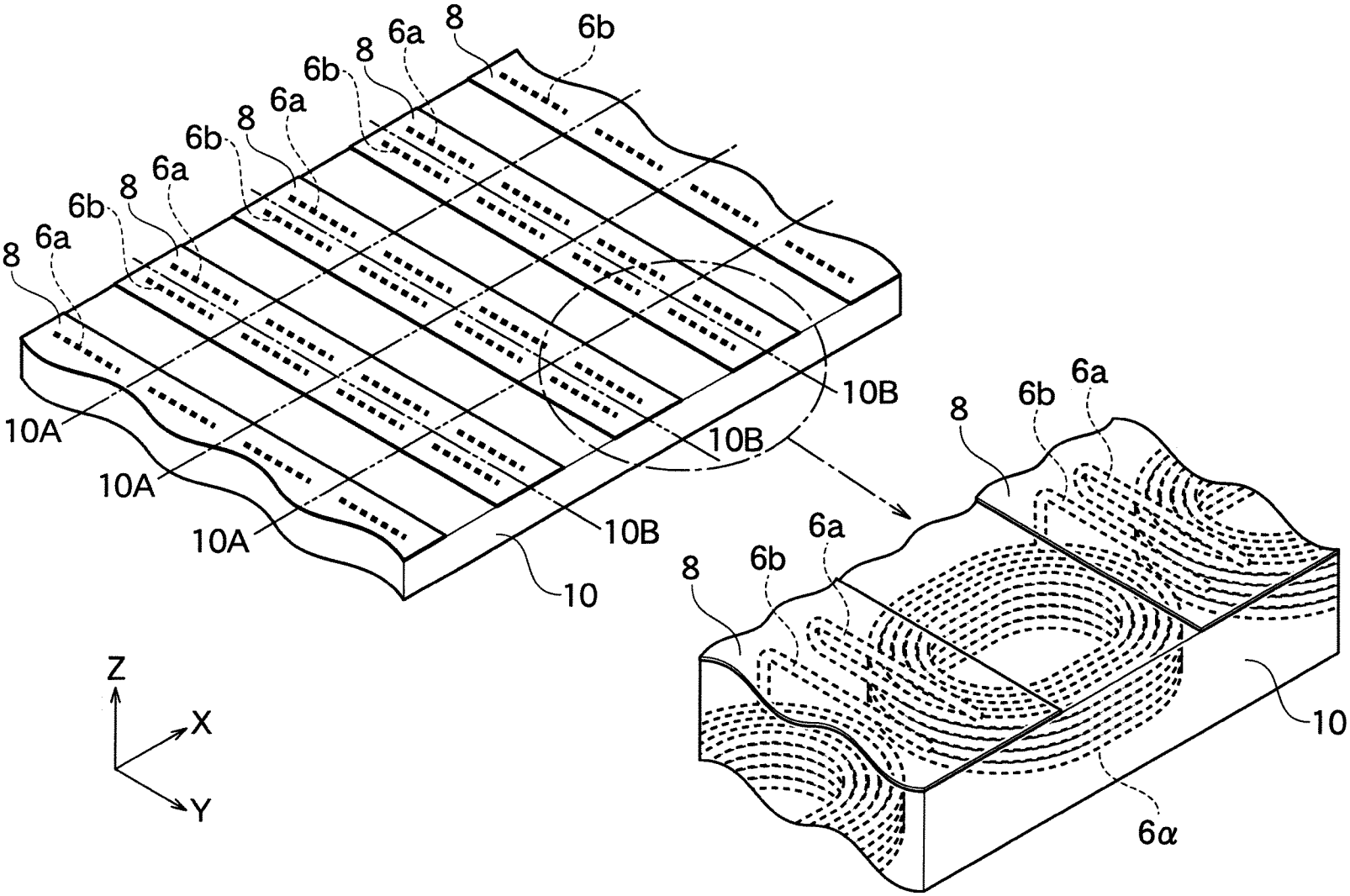
FIG. 2B is a perspective view showing a next step of FIG. 2A.
Figure 2C:
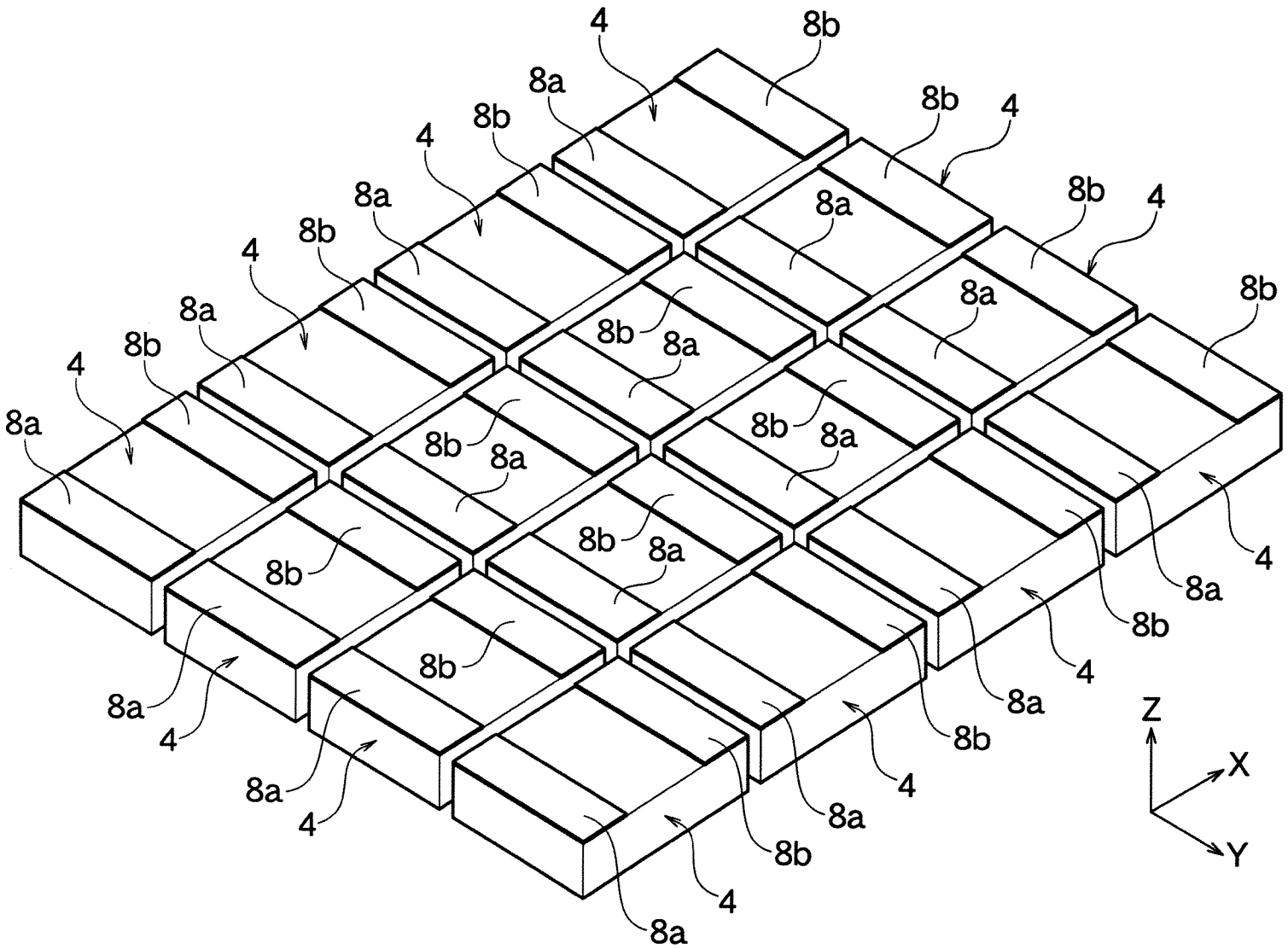
FIG. 2C is a perspective view showing a next step of FIG. 2B.
Figure 2D:
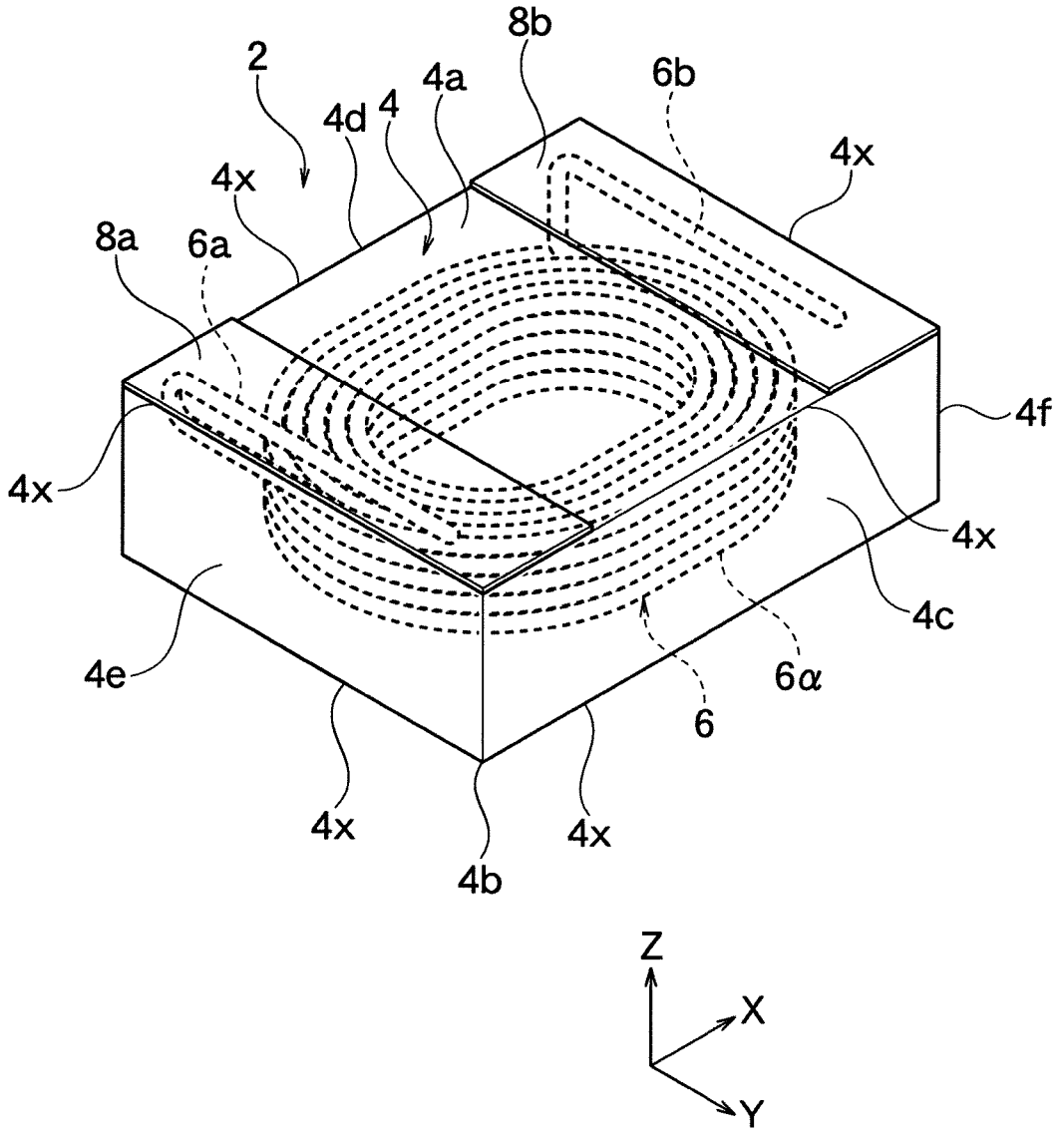
FIG. 2D is a perspective view showing a next step of FIG. 2C.

As shown in FIG. 2D, the component body 4 contains a wire 6 as a conductor wound in a coil shape. In the present embodiment, the wire 6 is preferably a wire covered with an insulation film. This is because even if the metal magnetic particles are dispersed in a main component constituting the component body 4, there is less risk of short circuit between a core wire and the metal magnetic particles of the component body 4, withstand voltage characteristics are improved, and deterioration of inductance is prevented.

In the present embodiment, for example, the wire 6 is formed by a round wire of a copper wire covered with an insulation film. This insulation film is an epoxy modified acrylic resin or so. Incidentally, the wire 6 may be a copper or silver wire covered with enamel, and may be a rectangular wire. The wire 6 is not limited to an insulated wire, and may be a wire that is not insulated. The wire 6 is not limited to a round wire, and may be a rectangular wire (flat wire), a square wire, or a litz wire. The core of the wire 6 is not limited to copper or silver, and may be an alloy containing them, another metal or alloy, or the like.

The wire 6 is wound in a coil shape by one or more turns (5×5 turns in the illustrated example) in the component body 4, and a coil portion 6*a* is thereby formed. In the present embodiment, the coil portion 6α is formed by an air-core coil where the wire 6 is wound by α-winding, but may be formed by an air-core coil where the wire 6 is wound by an ordinary normal wise or by an air-core coil where the wire 6 is wound by an edge wise.

A first lead 6*a* is formed at one end of the wire 6, and a second lead 6*b* is formed at the other end of the wire 6. In the illustrated example, the leads 6*a* and 6*b* extend toward the side surface 4*c* in the Y-axis direction. In the present embodiment, a part of the outer circumference of the first lead 6*a* of the wire 6 is exposed from one end of the mounting surface 4*a* in the X-axis direction (near side surface 4*e*), and a part of the outer circumference of the second lead 6*b* of the wire 6 is exposed from the other end of the mounting surface 4*a* in the X-axis direction (near side surface 4*f*).

From the viewpoint of reducing the height of the inductor 2, a part of the outer circumferences of the leads 6*a* and 6*b* is preferably exposed from the mounting surface 4*a*, but the whole of the outer circumferences of the leads 6*a* and 6*b* may be exposed from the mounting surface 4*a*.

As shown in FIG. 1A and FIG. 1B, a first terminal electrode 8*a* is formed on one end of the mounting surface 4*a* in the X-axis direction (near side surface 4*e*), and a second terminal electrode 8*b* is formed on the other end of the mounting surface 4*a* in the X-axis direction (near side surface 4*f*).

Unlike a normal electronic device where a terminal electrode is also formed on a side surface, the first terminal electrode 8*a* is formed only on the mounting surface 4*a* without covering the side surfaces 4*c* to 4*e* of the component body 4 in the present embodiment. The first terminal electrode 8*a* has an elongated shape in the Y-axis direction and covers the mounting surface 4*a* from one end of the mounting surface 4*a* in the Y-axis direction near the side surface 4*c* to the other end of the mounting surface 4*a* in the Y-axis direction near the side surface 4*d*. As shown in FIG. 2D, the first terminal electrode 8*a* covers a part of the outer circumference of the first lead 6*a* exposed from the mounting surface 4*a* and is electrically connected with the first lead 6*a*.

Likewise, unlike a normal electronic device where a terminal electrode is also formed on a side surface, the second terminal electrode 8*b* is formed only on the mounting surface 4*a* without covering the side surfaces 4*b* to 4*d* or 4*f* of the component body 4 in the present embodiment. The second terminal electrode 8*b* has an elongated shape in the Y-axis direction and covers the mounting surface 4*a* from one end of the mounting surface 4*a* in the Y-axis direction near the side surface 4*c* to the other end of the mounting surface 4*a* in the Y-axis direction near the side surface 4*d*. The second terminal electrode 8*b* covers a part of the outer circumference of the second lead 6*b* exposed from the mounting surface 4*a* and is electrically connected with the second lead 6*b*.

As shown in FIG. 1C, the terminal electrodes 8*a* and 8*b* function as a joint surface of solder with an electrode (land) of the circuit board 20.

As shown in FIG. 1A, the first terminal electrode 8*a* has a first edge 8*a*1 at one end of the first terminal electrode 8*a* in the Y-axis direction near the side surface 4*c*, a second edge 8*a*2 at the other end of the first terminal electrode 8*a* in the Y-axis direction near the side surface 4*d*, and a third edge 8*a*3 at one end of the first terminal electrode 8*a* in the X-axis direction near the side surface 4*e*.

Figure 1D:
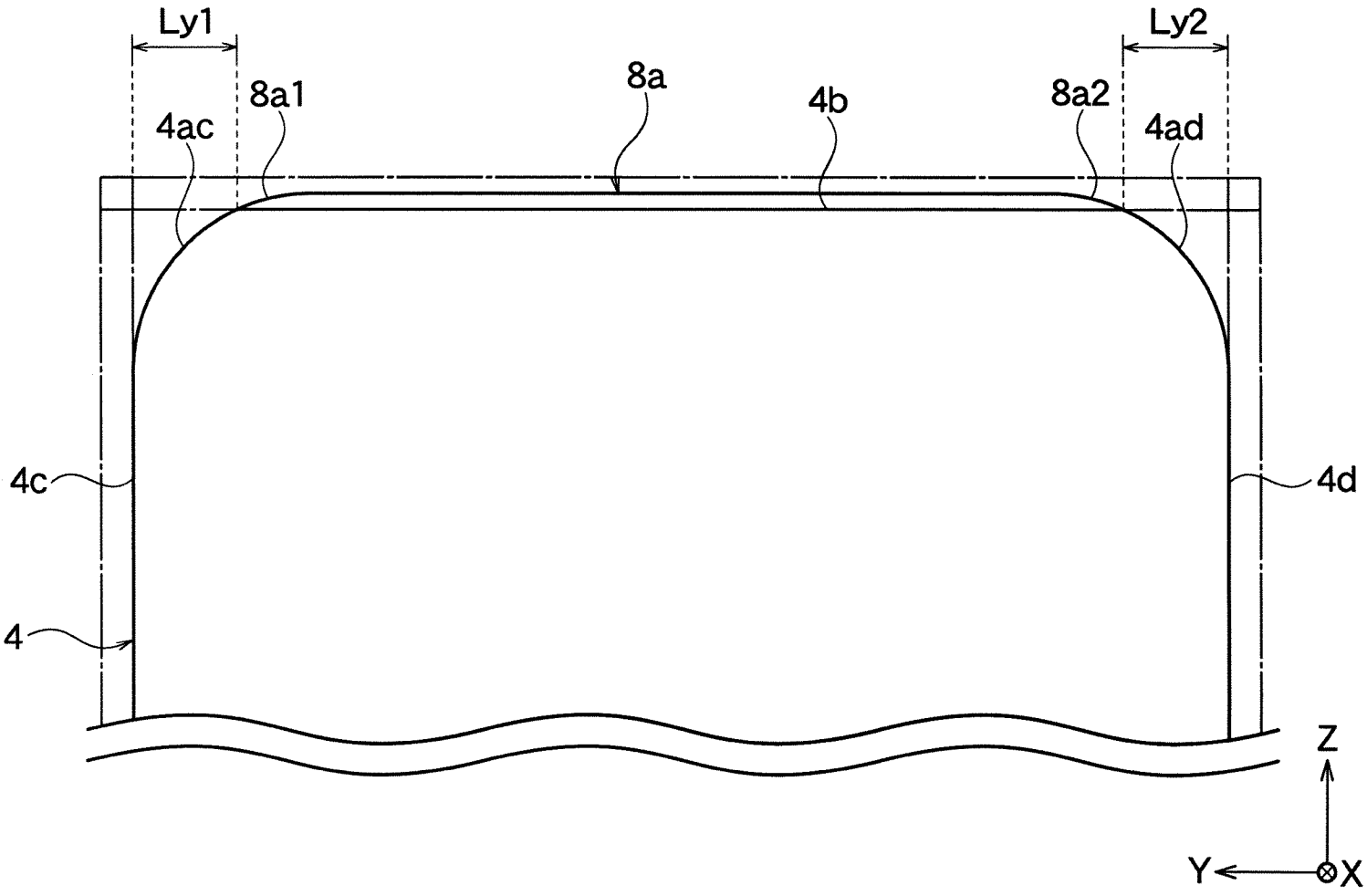
FIG. 1D is a partially enlarged cross-sectional view of the electronic device along the ID-ID line shown in FIG. 1A.
Figure 1E:
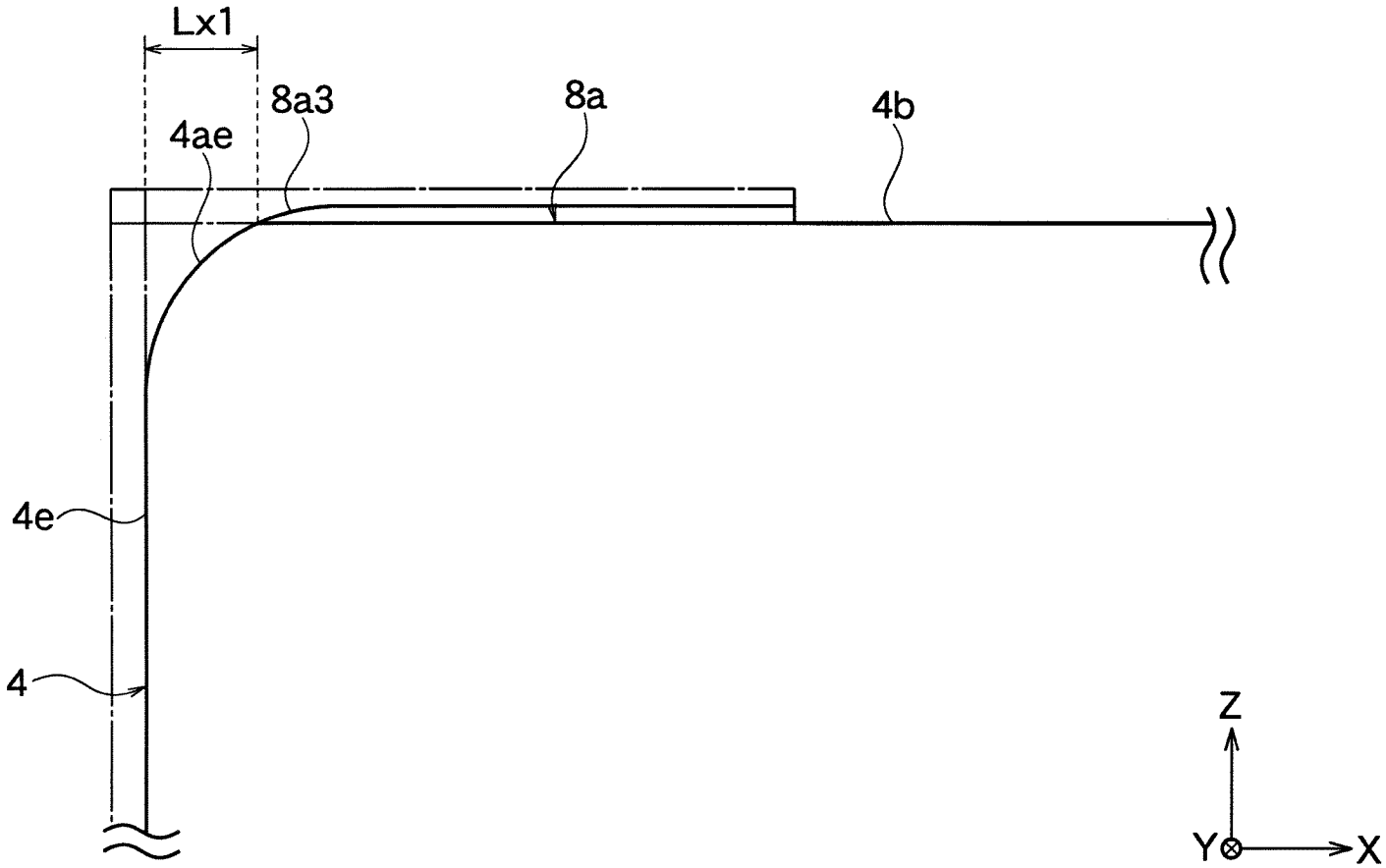
FIG. 1E is a partially enlarged cross-sectional view of the electronic device along the IE-IE line shown in FIG. 1A.

In the present embodiment, as shown in FIG. 1D, the first edge 8*a*1 of the first terminal electrode 8*a* becomes thinner toward the chamfered part 4*ac*, and the second edge 8*a*2 of the first terminal electrode 8*a* becomes thinner toward the chamfered part 4*ad*. As shown in FIG. 1E, the third edge 8*a*3 of the first terminal electrode 8*a* becomes thinner toward the chamfered part 4*ae*. In the first terminal electrode 8*a* of the present embodiment, the ends of the edges 8*a*1, 8*a*2, and 8*a*3 are not formed on the chamfered parts 4*ac*, 4*ad*, or 4*ae* of the component body 4, but are formed on a flat part of the mounting surface 4*a* so as to contact with the chamfered parts 4*ac*, 4*ad*, and 4*ae* of the component body 4.

The second terminal electrode 8*b* has a first edge 8*b*1 at one end of the second terminal electrode 8*b* in the Y-axis direction near the side surface 4*c*, a second edge 8*b*2 at the other end of the second terminal electrode 8*b* in the Y-axis direction near the side surface 4*d*, and a third edge 8*b*3 at one end of the second terminal electrode 8*b* in the X-axis direction near the side surface 4*f*.

Although not illustrated, the first edge 8*b*1 of the second terminal electrode 8*b* becomes thinner toward the chamfered part 4*ac* shown in FIG. 1A, the second edge 8*b*2 of the second terminal electrode 8*b* becomes thinner toward the chamfered part 4*ad*, and the third edge 8*b*3 of the second terminal electrode 8*b* becomes thinner toward the chamfered part 4*af*. In the second terminal electrode 8*b* of the present embodiment, the ends of the edges 8*b*1, 8*b*2, and 8*b*3 are not formed on the chamfered parts 4*ac*, 4*ad*, or 4*af* of the component body 4, but are formed on a flat part of the mounting surface 4*a* so as to contact with the chamfered parts 4*ac*, 4*ad*, and 4*af* of the component body 4.

Preferably, the terminal electrodes 8*a* and 8*b* have a thickness of 10 to 100 μm or more. In this range, the edges 8*a*1 to 8*a*3 and 8*b*1 to 8*b*3 of the terminal electrodes 8*a* and 8*b* can gradually be thinner toward the chamfered parts 4*ac* to 4*af*. In the present embodiment, however, as mentioned below, the component body 4 with the terminal electrodes 8*a* and 8*b* is chamfered, and the terminal electrodes 8*a* and 8*b* are polished together. That is, the thicknesses of the terminal electrodes 8*a* and 8*b* are the thicknesses of the terminal electrodes 8*a* and 8*b* after the chamfering, and the thicknesses of the terminal electrodes 8*a* and 8*b* before the chamfering are larger than the thicknesses of the terminal electrodes 8*a* and 8*b* as shown by the one-dot chain lines in FIG. 1D and FIG. 1E.

As shown in FIG. 1B, a distance Ly1 between the edges 8*a*1 and 8*b*1 and the side surface 4*c*, a distance Ly2 between the edges 8*a*2 and 8*b*2 and the side surface 4*d*, a distance Lx1 between the edge 8*a*3 and the side surface 4*e*, and a distance Lx2 between the edge 8*b*3 and the side surface 4*f* depend upon how large the chamfered parts 4*ac* to 4*af* are, and are preferably 0.03 to 0.20 mm.

The terminal electrodes 8*a* and 8*b* are formed by a multilayer electrode film of a base electrode film and a plating film, for example. The plating film may be formed on the base electrode film constituted by a conductive paste film containing a metal of Sn, Ag, Ni, C, etc. or an alloy of these metals. In this case, the plating film is formed after the base electrode film is formed and thereafter subjected to a dry treatment or a heat treatment. For example, the plating film is a metal of Sn, Au, Ni, Pt, Ag, Pd, etc. or an alloy of these metals. Incidentally, the terminal electrodes 8*a* and 8*b* may be formed by sputtering.

Next, described is a method of manufacturing the inductor 2 of the present embodiment. In the method of the present embodiment, initially prepared are a molding die with cavities and a plurality (16 in the present embodiment) of wires 6 (coil portions 6*a*) wound in air-core coil.

The wires 6 (coil portions 6α) are embedded in the molding die (embedding step), and a pressed powder molding is carried out so that at least a part of the outer circumferences of the leads 6*a* and 6*b* is exposed from one of the surfaces of the substrate 10 as shown in FIG. 2A. The pressed powder molding is carried out in such a manner that a synthetic resin in a molten state where metal magnetic particles are dispersed is poured into the molding die containing the wires 6 and is cured by, for example, heat.

In the embedding step, the leads 6*a* and 6*b* of each wire 6 are aligned to extend in the Y-axis direction. The wires 6 are arranged in lattice so that the intervals between the wires 6 (coil portions 6α) adjacent to each other in the X-axis direction and the intervals between the wires 6 (coil portions 6α) adjacent to each other in the Y-axis direction are approximately equal to each other. Incidentally, the leads 6*a* and 6*b* of each wire 6 can be formed by bending the ends of the wire 6 drawn from the coil portion 6α toward the opposite direction to the drawn direction by about 180°.

Obtained is a substrate (molded body) 10 containing the plurality of wires 6 so that at least a part of the leads 6*a* and 6*b* is exposed. Incidentally, this method is not the only one method of obtaining the substrate 10 containing the plurality of wires 6. For example, the substrate 10 may be obtained by preparing two magnetic substrates, arranging the wires 6 in lattice on one of the magnetic substrates (lower magnetic substrate), covering them with the other magnetic substrate (upper magnetic substrate) from above, and integrating the magnetic substrates.

Next, as shown in FIG. 2B, a plurality (five in the illustrate example) of terminal electrode patterns 8 is formed on one of the surfaces of the substrate 10 containing the wires 6 by a paste method and/or a plating method, and is subjected to a dry treatment or a heat treatment as necessary (terminal-electrode formation step). From the viewpoint of easy manufacture, the terminal electrode patterns 8 are preferably formed by a screen printing using a silver paste.

Preferably, the terminal electrode patterns (silver paste or so) 8 are formed even on boundaries with the side surfaces of the substrate 10. Incidentally, even if the terminal electrodes protrude on the side surfaces of the substrate 10, these protrusions can be removed by a barrel polishing mentioned below.

In the terminal-electrode formation step, the terminal electrode patterns 8 are formed on one of the surfaces of the substrate 10 so as to cover even near the side surfaces of the substrate 10 (from the corner at one of the ends of the substrate 10 in the Y-axis direction to the corner at the other end of the substrate 10 in the Y-axis direction) and so as to be connected with a part of the outer circumferences of the leads 6*a* and 6*b* of the wire 6 exposed from one of the surfaces of the substrate 10. In the example of FIG. 2B, the terminal electrode patterns 8 continuously cover the substrate 10 from the corner at one of the ends of the substrate 10 in the Y-axis direction to the corner at the other end of the substrate 10 in the Y-axis direction, but may intermittently cover the substrate 10.

The terminal electrode patterns 8 are formed slenderly on the substrate 10 in the Y-axis direction so that the first lead 6*a* of the wire 6 in each line and the second lead 6*b* of the wire 6 in each line adjacent to each line of the first lead 6*a* of the wire 6 in the X-axis direction are covered with the single terminal electrode pattern 8. The terminal electrode pattern 8 is polished and becomes thinner in the barrel polishing mentioned below, and is thereby formed to be thick in advance by the amount to be polished.

Next, as shown in FIG. 2C, the substrate 10 with the terminal electrode patterns 8 is cut along cut-scheduled lines 10A extending in the X-axis direction and cut-scheduled lines 10B (terminal electrode patterns 8) extending in the Y-axis direction, and is divided into 16 pieces (cut step). As a result, the component body 4 containing the single wire 6 is obtained as shown in FIG. 2D. The substrate 10 is cut by any method, such as cutting tools of dicing saws, wire saws, or the like and laser. From the viewpoint of easy cut, a dicing saw having a sharp cut surface is preferably used.

Next, the component body 4 obtained is subjected to a barrel polishing (barrel polishing step). For example, the barrel polishing is carried out using a centrifugal barrel device having a rotatable barrel vessel. Incidentally, the polishing can be dry type or wet type, but a wet type barrel polishing is preferable.

In the barrel polishing step, polished are the portion shown by the two-dot chain lines of FIG. 1E (component body before polishing) and the portion shown by the one-dot chain line of FIG. 1E (terminal electrode before polishing). As a result, the chamfered parts 4*ac* to 4*af* and 4*bc* to 4*bf* shown in FIG. 1A are formed at intersections 4X between the mounting surface 4*a* (surface corresponding to one of the surfaces of the substrate 10 mentioned above) and the side surfaces 4*c* to 4*f* and at intersections 4X between the rear surface 4*b* opposite to the mounting surface 4*a* and the side surface 4*c* to 4*f*.

In the barrel polishing step, the terminal electrodes 8*a* and 8*b* are polished together with the component body 4. Thus, as shown in FIG. 1D and FIG. 1E, the edges 8*a*1 to 8*a*3 and 8*b*1 to 8*b*3 of the terminal electrodes 8*a* and 8*b* after the polishing (see the solid lines) are thinner than the edges 8*a*1 to 8*a*3 and 8*b*1 to 8*b*3 of the terminal electrodes 8*a* and 8*b* before the polishing (see the one-dot chain lines), and become thinner toward the chamfered parts 4*ac*, 4*ad*, and 4*ae*. The portion other than the edges 8*a*1 to 8*a*3 and 8*b*1 to 8*b*3 of the terminal electrodes 8*a* and 8*b* after the polishing (see the solid lines) is uniformly thinner by a predetermined amount than the edges 8*a*1 to 8*a*3 and 8*b*1 to 8*b*3 of the terminal electrodes 8*a* and 8*b* before the polishing (see the one-dot chain lines).

In the barrel polishing, a polishing speed (R-formation speed) at the intersections 4X of the component body 4 shown in FIG. 2D is normally larger than film reduction speeds of the terminal electrodes 8*a* and 8*b*. The polishing speed is appropriately controllable using media for barrel polishing (spherical media).

In the above-mentioned method, the edges 8*a*1 to 8*a*3 and 8*b*1 to 8*b*3 of the terminal electrodes 8*a* and 8*b* are chamfered together with the intersections 4X between one of the surfaces and the side surfaces of the cut substrate 20 in forming the chamfered parts 4*ac* to 4*af* and 4*bc* to 4*bf*. Thus, it is possible to easily manufacture an aggregation of an inductor 2 where the edges 8*a*1 to 8*a*3 and 8*b*1 to 8*b*3 of the terminal electrodes 8*a* and 8*b* gradually become thinner toward the chamfered parts 4*ac* to 4*af* (toward the side surfaces 4*c* to 4*f*).

The terminal electrode patterns 8 do not attach to each cut surface of the aggregation of the inductor 2, and it is possible to manufacture the inductor 2 with the terminal electrodes 8*a* and 8*b* formed only on the mounting surface 4*a*.

In the above-mentioned method, the steps are carried out in the order of the terminal-electrode formation step, the cut step, and the barrel polishing step after obtaining the substrate (molded body) 10 containing a plurality of wires 6, but the steps may be carried out in the order of the cut step, the terminal-electrode formation step, and the barrel polishing step.

That is, the cut step is carried out after obtaining the substrate (molded body) 10 containing a plurality of wires 6, and the component bodies 4 containing a single wire 6 are obtained so that at least a part of the leads 6*a* and 6*b* is exposed. Next, the terminal-electrode formation step is carried out for the component bodies 4 (pieces of the inductor 2) containing a single wire 6.

In the terminal-electrode formation step, the terminal electrodes 8*a* and 8*b* are formed on the mounting surface 4*a* of the component body 4 containing a single wire 6 by a paste method and/or a plating method, and are subjected to a dry treatment or a heat treatment as necessary. At this time, the terminal electrodes 8*a* and 8*b* are formed on the mounting surface 4*a* of the component body 4 so as to cover even boundaries with the side surfaces 4*c* and 4*d* of the component body 4 (from the corner at one of the ends of the component body 4 in the Y-axis direction to the corner at the other end of the component body 4 in the Y-axis direction) and so as to be connected with a part of the outer circumferences of the leads 6*a* and 6*b* of the wire 6 exposed from one of the surfaces of the component body 4.

Next, the component bodies 4 obtained are subjected to the above-mentioned barrel polishing step, and pieces of the inductor 2 are obtained.

According to the above-mentioned method, the edges 8*a*1 to 8*a*3 and 8*b*1 to 8*b*3 of the terminal electrodes 8*a* and 8*b* are chamfered together with the intersections between the mounting surface 4*a* and the side surfaces 4*c* to 4*f* of the component body 4 in forming the chamfered parts 4*ac* to 4*af*. Thus, it is possible to easily manufacture the pieces of the inductor 2 where the edges 8*a*1 to 8*a*3 and 8*b*1 to 8*b*3 of the terminal electrodes 8*a* and 8*b* become gradually thinner toward the chamfered parts 4*ac* to 4*af* and 4*bc* to 4*bf* (toward the side surfaces 4*c* to 4*f*).

In the inductor 2 according to the present embodiment, the chamfered parts 4*ac* to 4*af* are formed at the intersections between the mounting surface 4*a* and the side surfaces 4*b* to 4*f* of the component body 4, and the edges 8*a*1 to 8*a*3 and 8*b*1 to 8*b*3 of the terminal electrodes 8*a* and 8*b* become thinner toward the chamfered parts 4*ac* to 4*af*. That is, the edges 8a1 to 8a3 and 8b1 to 8b3 of the terminal electrodes 8a and 8b are chamfered integrally with the intersections between the mounting surface 4a and the side surfaces 4b to 4f of the component body 4 in forming the chamfered parts 4ac to 4af in the present embodiment. Thus, the edges 8a1 to 8a3 and 8b1 to 8b3 of the terminal electrodes 8a and 8b are arranged inside the side surfaces 4b to 4f of the component body 4 and are smoothly (continuously) connected with the chamfered surfaces of the chamfered parts 4ac to 4af while being gently curved. During high-density mounting, it thereby becomes harder for solder to protrude outward from the component body 4 and to reach between the inductors 2 adjacent to each other, compared to prior arts. Thus, it is possible to effectively prevent generation of solder bridge between the terminal electrodes 8a and 8b adjacent to each other and to effectively prevent generation of short circuit failure between the terminal electrodes 8a and 8b adjacent to each other. Since the edges 8a1 to 8a3 and 8b1 to 8b3 of the terminal electrodes 8a and 8b reach near the chamfered parts 4ac to 4af, it is possible to secure sufficient areas of the terminal electrodes 8a and 8b and to secure an excellent mounting strength even if a chip size is small.

Incidentally, the present invention is not limited to the above-mentioned embodiment, and may be changed variously within the scope of the present invention.

Figure 1F:
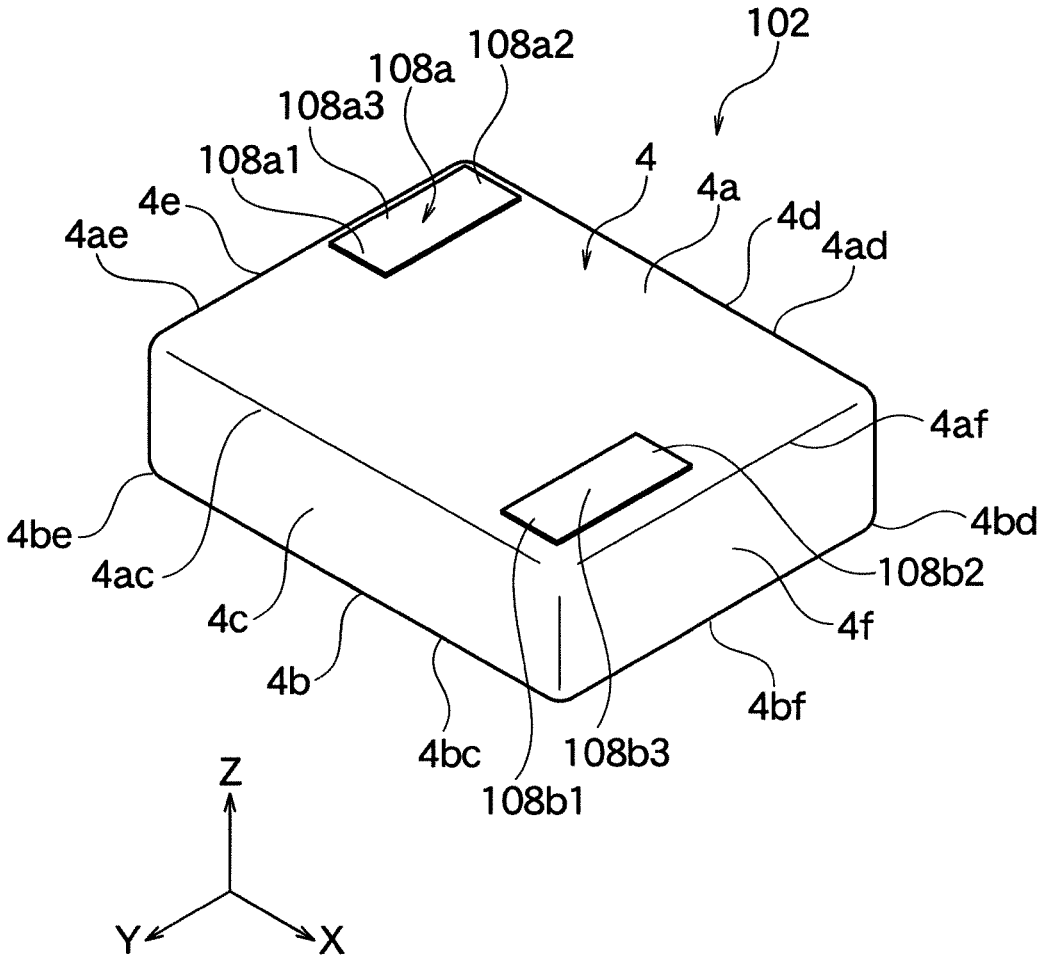
FIG. 1F is a perspective view of a variation of the electronic device shown in FIG. 1A.

The above-mentioned embodiment illustrates that the edges 8a1 to 8a3 and 8b1 to 8b3 of the terminal electrodes 8a and 8b become thinner toward the chamfered parts 4ac to 4af as shown in FIG. 1A, but the edges 8a1 to 8a3 and 8b1 to 8b3 are not limited to this structure. In the example of FIG. 1F, for example, only edges 108a2, 108a3, 108b1, and 108b3 among edges 108a1 to 108a3 and 108b1 to 108b3 of terminal electrodes 108a and 108b are formed to become thinner toward the chamfered parts 4ac to 4af, but the edges 108a1 and 108b2 are not formed to become thinner toward the chamfered parts 4ac and 4af.

That is, any of the edges 8a1 to 8a3 and 8b1 to 8b3 of the terminal electrodes 8a and 8b may become thinner toward the chamfered parts 4ac and 4ad.

The above-mentioned embodiment describes a method of manufacturing the inductor 2, but if the electronic device according to the present invention is another electronic device of a capacitor, a resistor, or the like, the substrate 10 or the component body 4 where an element of this electronic device is embedded (contained) is subjected to the above-mentioned steps (cut step, terminal-electrode formation step, barrel polishing step, etc.).

The wires 6 have a winding shape of elliptical spiral in the above-mentioned embodiment, but the wires 6 may have a winding shape of circular spiral, square spiral, concentric circle, or the like.

NUMERICAL REFERENCES

2, 102 . . . inductor (coil device)
4 . . . component body
4ac, 4ad, 4ae, 4af, 4bc, 4bd, 4be, 4bf . . . chamfered part
6 . . . wire
6α . . . coil portion
6a, 6b . . . lead end
8, 8a, 8b, 108a, 108b . . . terminal electrode
8a1, 8a2, 8a3, 8b1, 8b2, 8b3, 108a1, 108a2, 108a3, 108b1, 108b2, 108b3 . . . edge
10 . . . substrate
10A, 10B . . . cut-scheduled line
20 . . . circuit board

The invention claimed is:

1. An electronic device, comprising:

a component body; and a terminal electrode formed on a mounting surface of the component body, wherein a chamfered part is formed at an intersection between the mounting surface and a side surface of the component body, an edge of the terminal electrode becomes thinner toward the chamfered part and is connected with a chamfered surface of the chamfered part, and the edge has an outer surface with a curvature and, when the edge ends at the chamfered surface, the curvature of the outer surface is the same as that of the chamfered surface.

2. The electronic device according to claim 1, wherein the chamfered part is formed by an R-plane or a C-plane.

3. An electronic device, comprising:

a component body containing an element; and a terminal electrode formed on a mounting surface of the component body, wherein a chamfered part is formed at an intersection between the mounting surface and a side surface of the component body, the element is connected with the terminal electrode, an edge of the terminal electrode becomes thinner toward the chamfered part and is connected with a chamfered surface of the chamfered part, and the edge has an outer surface with a curvature and, when the edge ends at the chamfered surface, the curvature of the outer surface is the same as that of the chamfered surface.

4. The electronic device according to claim 3, wherein the chamfered part is formed by an R-plane or a C-plane.

5. The electronic device according to claim 3, wherein the edge of the terminal electrode is continuously connected with the chamfered surface of the chamfered part.

6. The electronic device according to claim 4, wherein the edge of the terminal electrode is continuously connected with the chamfered surface of the chamfered part.

7. An electronic device, comprising:

a component body having a mounting surface, a side surface and a chamfered part formed at an intersection between the mounting surface and the side surface, the chamfered part having a chamfered surface; and a terminal electrode that is formed on the mounting surface and is not formed on the chamfered part, the terminal electrode having an edge portion, the edge portion extending from the mounting surface to the chamfered part without being formed on the chamfered surface, becoming thinner when approaching the chamfered part, and being connected with and ending at the chamfered surface, wherein the edge has an outer surface with a curvature and, when the edge ends at the chamfered surface, the curvature of the outer surface is the same as that of the chamfered surface.

8. The electronic device according to claim 7, wherein the component body contains an element that is connected with the terminal electrode.

9. The electronic device according to claim 7, wherein the chamfered part is formed by an R-plane or a C-plane.

10. The electronic device according to claim 7, wherein the edge portion is continuously connected with the chamfered surface of the chamfered part.

* * * * *